US005680825A

United States Patent [19]

Humble

[11] Patent Number: 5,680,825

[45] Date of Patent: Oct. 28, 1997

[54] THREAD-TAKE-UP CONTROLLER AND METHOD

[75] Inventor: Ralph A. Humble, Liberty, N.C.

[73] Assignee: MacPherson Meistergram, Inc., Greensboro, N.C.

[21] Appl. No.: 562,432

[22] Filed: Nov. 24, 1995

[51] Int. Cl.[6] ..... D05B 19/00; D05C 11/00

[52] U.S. Cl. ..... 112/102.5; 112/243; 112/475.19

[58] Field of Search ..... 112/102.5, 241, 112/242, 243, 470.06, 470.01, 470.04, 470.02, 475.19, 255, 155, 163

[56] References Cited

U.S. PATENT DOCUMENTS

| | | | |
|---|---|---|---|
| 4,408,554 | 10/1983 | Takiguchi et al. | 112/243 X |
| 4,967,679 | 11/1990 | Hara et al. | 112/255 X |
| 5,327,840 | 7/1994 | Tajima et al. | 112/102.5 |

*Primary Examiner*—Peter Nerbun

[57] ABSTRACT

A device and method for continuously regulating the amount of thread stripped from a supply spool and fed to a sewing needle during embroidery is provided. In commercial embroidering, the lengths of consecutive stitches can vary widely. The invention allows the machine to apply optimal tension to all embroidery stitches, regardless of their differing lengths. Pulling all stitches under optimal tension improves the appearance of the finished stitches and reduces the breakage and fraying of the thread. In the preferred embodiment of the invention, a digital computer controls a programmable servomotor, which in turn regulates the action of the embroidery machine's take-up and driver lever. The take-up in turn regulates the length of thread stripped from the supply bobbin and fed to the current stitch. In an alternative embodiment, the take-up and driver lever are replaced by a wheel, which is connected to the servomotor.

18 Claims, 6 Drawing Sheets

THREAD-TAKE-UP CONTROLLER AND METHOD

BACKGROUND OF THE INVENTION

1. Field of the Invention

This invention describes a thread take-up controller that regulates the length of thread fed to a sewing needle as used on multiple head sewing machines in the field of commercial embroidering.

2. Description of the Prior Art And Objectives of the Invention

It is well known in the sewing or embroidery arts that a sewing machine take-up strips thread from a supply spool and feeds that thread to a needle. This take-up is typically activated by eccentric cams or other mechanical linkages. The length of thread stripped from the spool by the take-up (hereinafter the "pull-off") determines the tension and the length of the stitches sewn.

Heretofore, before sewing, the sewing machine operator adjusts the take-up to provide an optimal pull-off. If the set pull-off is too long, then the loose thread can jam the machine or cause stitches that are loose and have poor quality. If the set pull-off is too short, then the stitch will be pulled with too much tension, leading to thread fraying, breakage, or fabric distortion.

It is also well known that in sewing, as opposed to embroidering, the stitch length typically is uniform. For example, when sewing a sleeve to a shirt body, the stitches sewn will have uniform length. Because the stitch length is uniform, setting the pull-off to allow for optimum tension in all the finished stitches is relatively simple as by a take-up, cam, or linkage adjustment.

Conversely, in embroidering it is known that the stitch length can vary widely across a given work piece as embroidery stitch lengths can vary from 0.1 mm to 12.7 mm. For example, when embroidering a design on a baseball cap, the design pattern may require stitches having several different lengths. Because the stitch lengths vary, the corresponding optimal pull-offs also vary.

Despite this fundamental difference between sewing and embroidering, prior art embroidery machines do not accommodate varying stitch lengths within a given work piece. Adjusting the take-up to provide optimal pull-offs for each different stitch length is impossible, because stopping the machine between each stitch to adjust the take-up for the next stitch is impractical.

Previously, when preparing an embroidery machine, the machine operator had to strike a "happy medium" or average length between the short and long stitches when adjusting the pull-off. However, this "average" approach has deficiencies as stated above: the short stitches are not pulled with sufficient tension, resulting in loose stitches; the long stitches are pulled with too much tension, resulting in thread or needle breakage, and thread fraying or fabric distortion.

These shortcomings in conventional embroidering have motivated the current invention. One objective of this invention is therefore to provide a device for an embroidery machine that allows for continuous adjustment of the take-up for each stitch on a given work piece.

It is still another objective to provide a device that will dynamically adjust the pull-off as needed during an embroidering stitch.

It is another objective to provide a method for controlling the length of thread fed to a sewing needle during an embroidery stitch.

It is yet another objective to provide a thread controller for a embroidery machine needle having a movable take-up, a pivotable driver lever, a driver controller, and a servomotor.

It is still another objective to provide a thread controller for a embroidery machine needle having a driver board utilizing digital circuitry.

It is still another objective to provide a thread controller for a sewing machine needle having a driver board utilizing analog circuitry.

Various other objectives and advantages of the present invention will become apparent to those skilled in the art as a more detailed description of the embodiments is presented below.

SUMMARY OF THE INVENTION

The aforesaid objectives can be realized by a device and method for controlling the length of thread stripped from a supply spool by a take-up and then fed to a sewing needle during embroidering. The device includes a driver board connected to a conventional servomotor, take-up, and driver lever.

The take-up strips thread from the supply spool as required by the length of the stitch anticipated and feeds it to a sewing needle. Simultaneously, the take-up applies tension to the thread. To accomplish this function, the take-up has an opening in one end to allow thread from the spool to pass therethrough. On the other end of the take-up is a crescent-shaped receptacle to allow pivotal engagement with a cylindrical extension on the driver lever.

The driver lever controls the movement of the take-up as the driver lever and the take-up move relative to one another. The driver lever indirectly controls the tension applied to the thread. On one end, the driver lever pivotally joins the take-up. On the opposite end of the driver lever, it is connected to the output shaft of a servomotor. Rotating the output shaft of the servomotor pivots the driver lever and in turn pivots the take-up. Thus, the amount of rotation of the servomotor shaft directly regulates the length of thread passing through the take-up.

The driver board controls the amount and direction of rotation of the servomotor's output shaft. The driver board may be implemented with either digital or analog electric circuitry. To perform its function, the driver board executes two basic steps. First, the driver board calculates the length of the stitch being sewn. To make this calculation, the driver board might collect signals from several locations on the machine, such as from the existing control circuitry of the sewing machine, or from inductive coils or optical switches strategically mounted on the sewing machine. Finally, the driver board sends electrical signals to the servo controller that cause the servomotor shaft to rotate. This rotation, as earlier explained, causes the take-up to pivot, which strips thread from the supply spool while applying tension to the thread. The thread is then fed to the needle for the desired stitch length.

In an alternative embodiment, the take-up and driver lever are replaced by a wheel mounted on the servomotor output shaft. The thread from the supply spool is fed around the circumference of this wheel and is then passed to the sewing needle. The servomotor can then control how much thread is passed to, or withdrawn from, the current stitch by rotating the wheel.

DETAILED DESCRIPTION OF THE PREFERRED EMBODIMENTS AND OPERATION OF THE INVENTION

Figure 1:
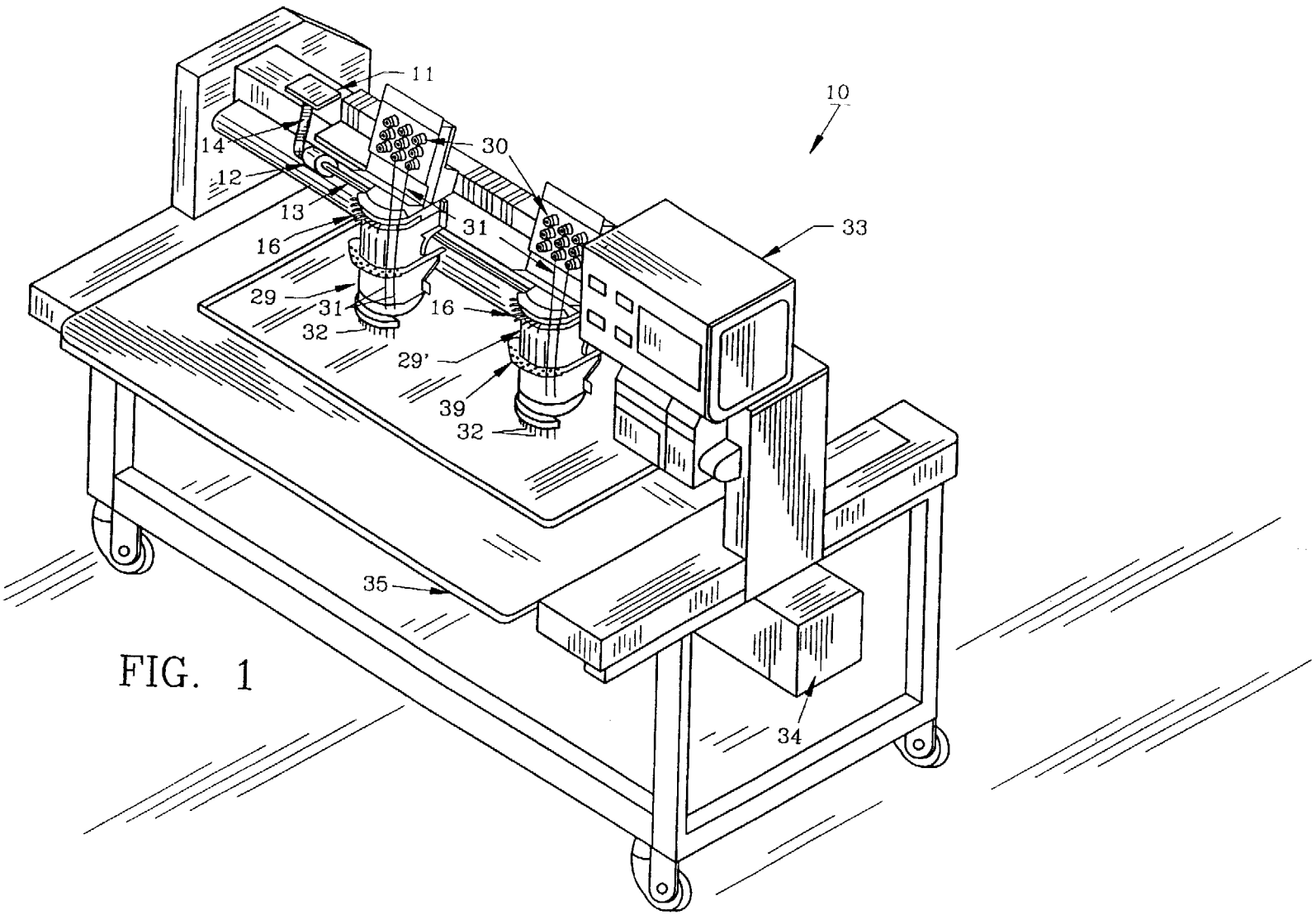
FIG. 1 shows an overall view of a multi-head embroidery machine with the invention incorporated therein.

Turning now to the drawings, FIGS. 1–5 show the preferred embodiment of the invention. FIG. 1 depicts an overall view of conventional commercial embroidery machine 10 with sewing heads 29 and 29', which include a plurality of movable thread take-ups 16, thread guides 39, sewing needles 32, threads 31, and thread supply spools 30. Thread 31 passes first from spool 30 through thread guide 39, then through take-up 16 to sewing needle 32. Frame 35 is movable beneath sewing needle 32 and holds a workpiece (not shown) to be embroidered. Control console 33 allows an operator to control and monitor sewing machine 10. Driver box 34 provides two-way electrical communication between control console 33 and the several components of sewing machine 10.

Driver board 11 and servomotor 12 of the invention are connected to sewing machine 10 with servomotor output shaft 13 extended from servomotor 12 to sewing head 29. Interface cable 14 electrically connects driver board 11 and servomotor 12. Although FIG. 1 shows two sewing heads 29 and 29', the invention is connected only to sewing head 29. In actual use, sewing heads 29 and 29' would either be connected to output shaft 13, or be supplied with a separate servomotor 12.

Figure 3:
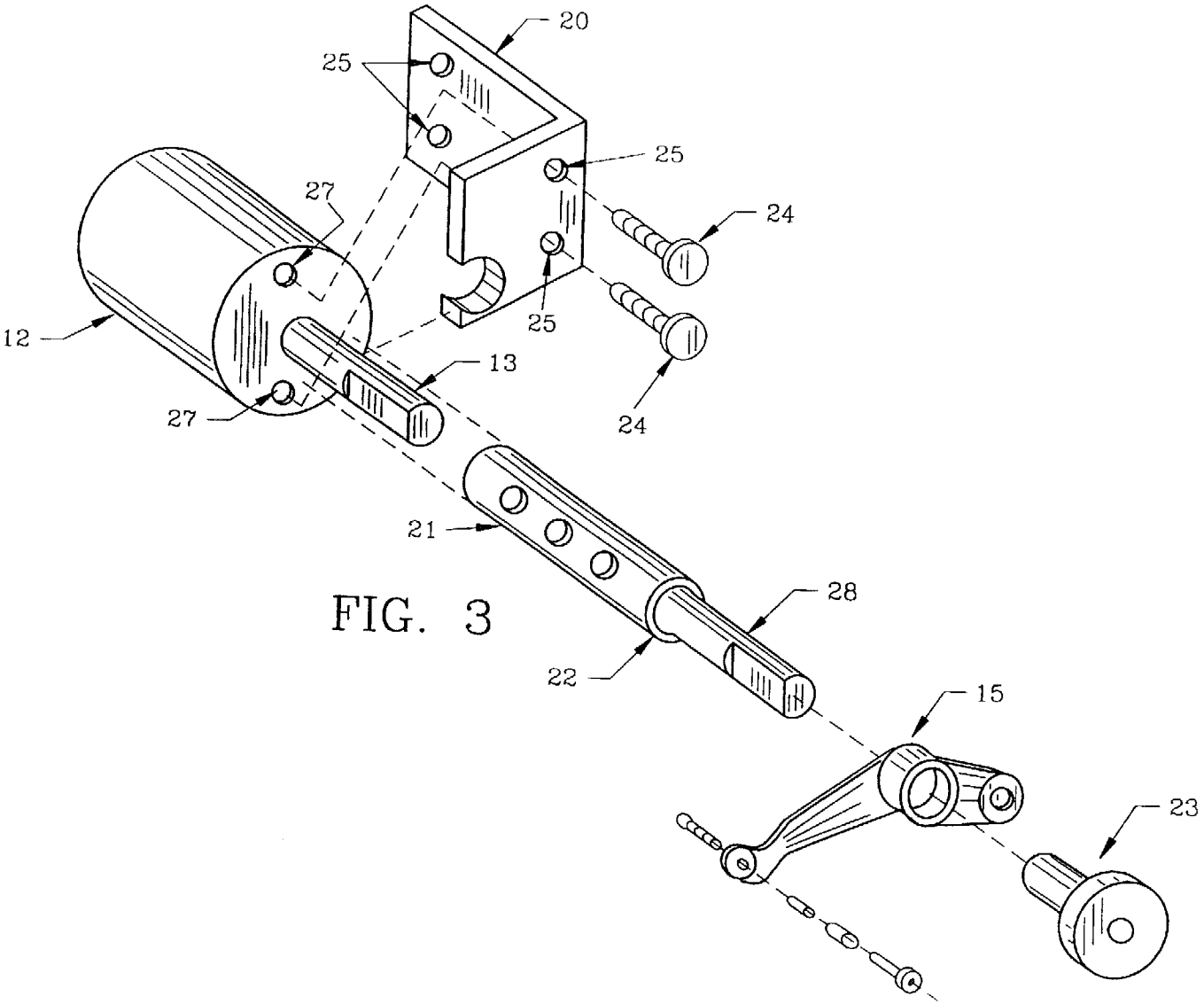
FIG. 3 pictures an exploded view of the servomotor and the driver lever.

The preferred method of using the invention to control the length of thread 31 stripped from supply spool 30 and fed to sewing needle 32 includes the following steps. First, thread 31 is passed through thread guide 39, then through opening 17 in pivotable take-up 16, as shown in FIG. 3. Next, the length of thread 31 stripped from supply spool 30 is continuously regulated by the degree of pivot of take-up 16 for each stitch in a given pattern. Finally, the controlled length of thread 31 is fed to sewing needle 32 to form a stitch.

Figure 2:
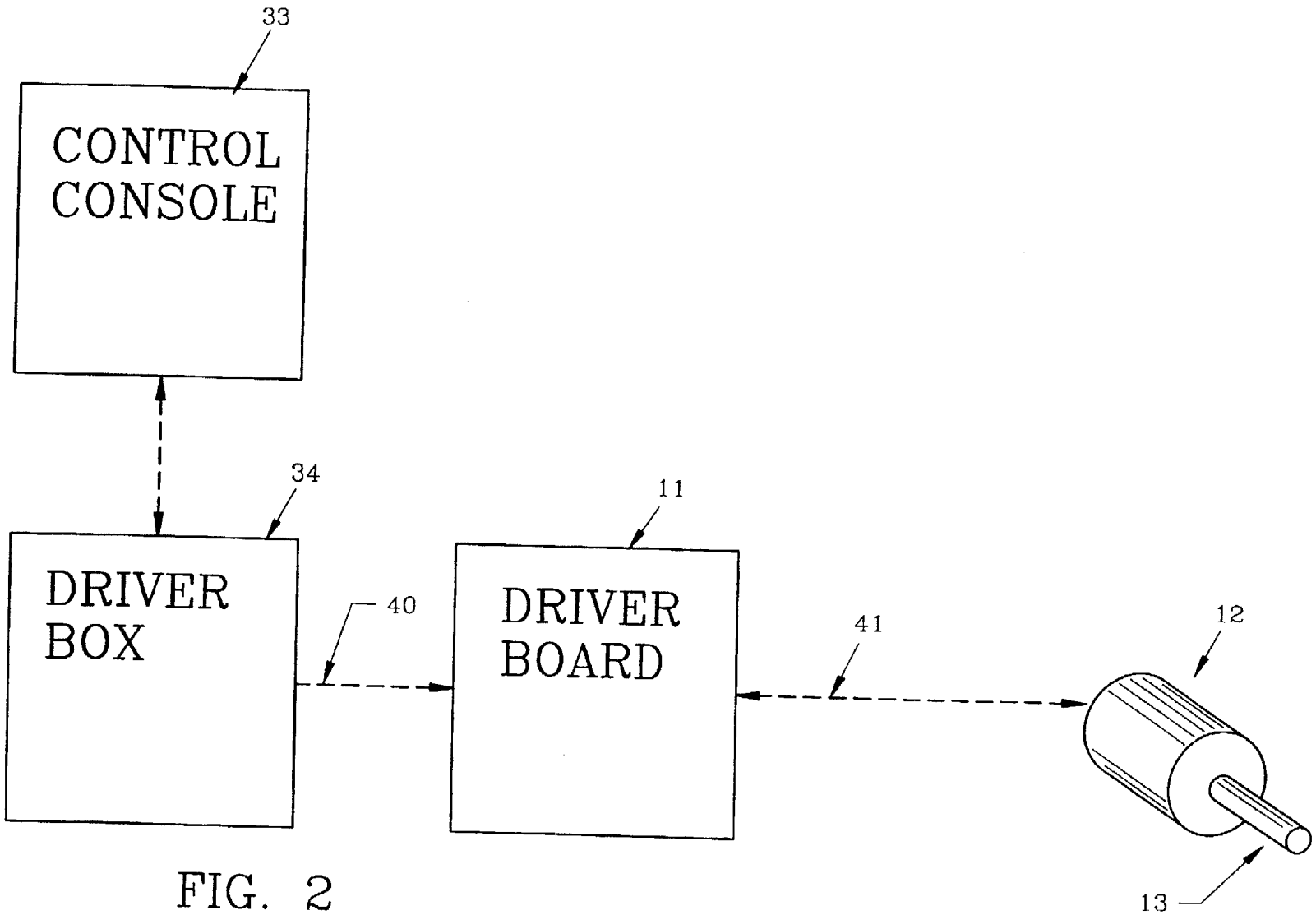
FIG. 2 illustrates a circuit block diagram depicting the electrical components of the invention.

FIG. 2 shows a block diagram of the electrical control system of the invention, including control console 33, driver box 34, driver board 11, servomotor 12, and input electrical signals 40. The dashed lines represent electrical signals and the arrowheads represent the direction of those signals. Control console 33 is electrically connected to driver box 34 to provide two-way communication therewith. Driver box 34 collects and processes a variety of electrical signals from the several components of embroidery machine 10. The most pertinent of these signals are the position of needle 32 and the movement of frame 35.

The relative position of needle 32 within its cycle is provided by an electro-optical coder (not shown). This coder is essentially a counter that starts counting when a given stitch begins and stops counting when that stitch is complete. When the stitch begins, the coder count is 000. When the stitch finishes, the coder count is 999. Thus, the coder effectively divides the cyclical movement of sewing needle 32 into 1000 partitions. For example, when the coder count reaches 500, machine 10 is approximately halfway through a given stitch cycle. Driver board 11 uses this coder count to synchronize and coordinate the movement of take-up 16 with the movement of frame 35 and the cycle of needle 32.

The movement of frame 35 depends on the length of the stitch being sewn. Short movements of frame 35 suggest short stitches, while longer movements of frame 35 suggest longer stitches. As shown in FIG. 2, driver board 11 takes as input signals from both the coder count and the movement of frame 35 as represented by electrical signals 40. Driver board 11 uses the following algorithm to calculate how to position take-up 16.

At the beginning of a given stitch, the coder count is 000 and take-up 16 is positioned 3 cm down from its top center position (hereinafter "down"). As machine 10 proceeds through a given stitch, needle 32 reciprocates, the coder count increments, and frame 35 moves as required by the stitch pattern. When the coder count reaches 067, driver board 11 commands servomotor 12 to position take-up 16 at 4.5 cm down, thus stripping approximately 1.5 cm of thread 31 from spool 30.

If frame 35 is still moving when the coder count reaches 620, then the current stitch must be longer. Thus, driver board 11 commands servomotor 12 to position take-up 16 at 6.5 cm down. This action strips approximately 2.0 cm more thread 31 to feed to the current longer stitch.

If frame 35 is still moving when the coder count reaches 675, then the current stitch must be yet longer. Thus, driver board 11 commands servomotor 12 to position take-up 16 at 7.0 cm down. This action strips approximately 0.5 cm more thread 31 to feed to the current yet longer stitch.

Regardless of the stitch length, when the coder count reaches 680, driver board 11 commands servomotor 12 to reverse direction and smoothly position take-up 16 at its top center position. This movement withdraws thread 31 and tightens the current stitch.

When the coder count reaches 800, driver board 11 commands servomotor 12 to reverse direction again and smoothly position take-up 16 so that when the coder count reaches 975, take-up 16 will be positioned at 3 cm down. This movement strips a small amount of thread 31 from spool 30 in preparation for the next stitch. When the coder count reaches 999, the current stitch is complete. Machine 10 then resets the coder count to 0, and the above cycle repeats for the next stitch.

Driver box 34 provides input electrical signals 40 to driver board 11. Thus, driver box 34 provides means to generate electrical input signals 40 to driver board 11. Driver board 11 provides means to process input electrical signals 40 into output electrical signals 41. Driver board 11 and servomotor 12 provide means to convert input electrical signals 40 into mechanical torque. Driver board 11 and servomotor 12 also provide means to control the tension applied to thread 31. Finally, driver board 11 provides means to calculate the length of the stitch currently being sewn.

Driver board 11 can be implemented with either digital or analog circuitry. Digital circuitry is preferred because it is generally flexible and programmable, although analog circuitry is generally faster. For a digital implementation, a programmable logic controller (PLC) integrated circuit chip can be used. A PLC is an inexpensive, relatively simple microprocessor. For the present invention, an 8-bit PLC chip with EPROM storage on-board is preferred.

In addition to intercepting existing control signals from driver box 34 as described above, driver board 11 may accept control signals generated from conventional inductive coils or optical switches placed strategically on the structure of sewing machine 10. Also, driver board 11 may be designed to interface directly to the main microprocessor controlling sewing machine 10 to obtain the length of the current stitch.

Servomotor 12 is conventional and provides feedback circuitry, unlike a conventional electric motor. This feedback circuitry allows one to monitor the position and rotation of output shaft 13, enabling driver board 11 precisely to position output shaft 13. Thus, driver board 11 provides electrical circuitry connected to servomotor 12 to control the latter. Alternatively, servomotor 12 could be replaced with a conventional stepper motor, which may or may not provide feedback circuitry.

In FIG. 3, an exploded view of servomotor 12 as connected to pivotable driver lever 15 is seen with servomotor 12 connected to mounting bracket 20. Mounting bolts 24 are passed through holes 25 in mounting bracket 20 and into threaded bolt holes 27, which are bored into the housing of servomotor 12. Output shaft 13 engages shaft sleeve 21, which includes reduced-diameter mounting section 28. Mounting section 28 defines abutment surface 22 against which driver lever 15 is bottomed. Finally, attachment collar 23 secures driver lever 15 to shaft sleeve 21. Servomotor 12 provides a movable driver controller that regulates the amount of thread 31 passing through take-up 16.

Figure 4:
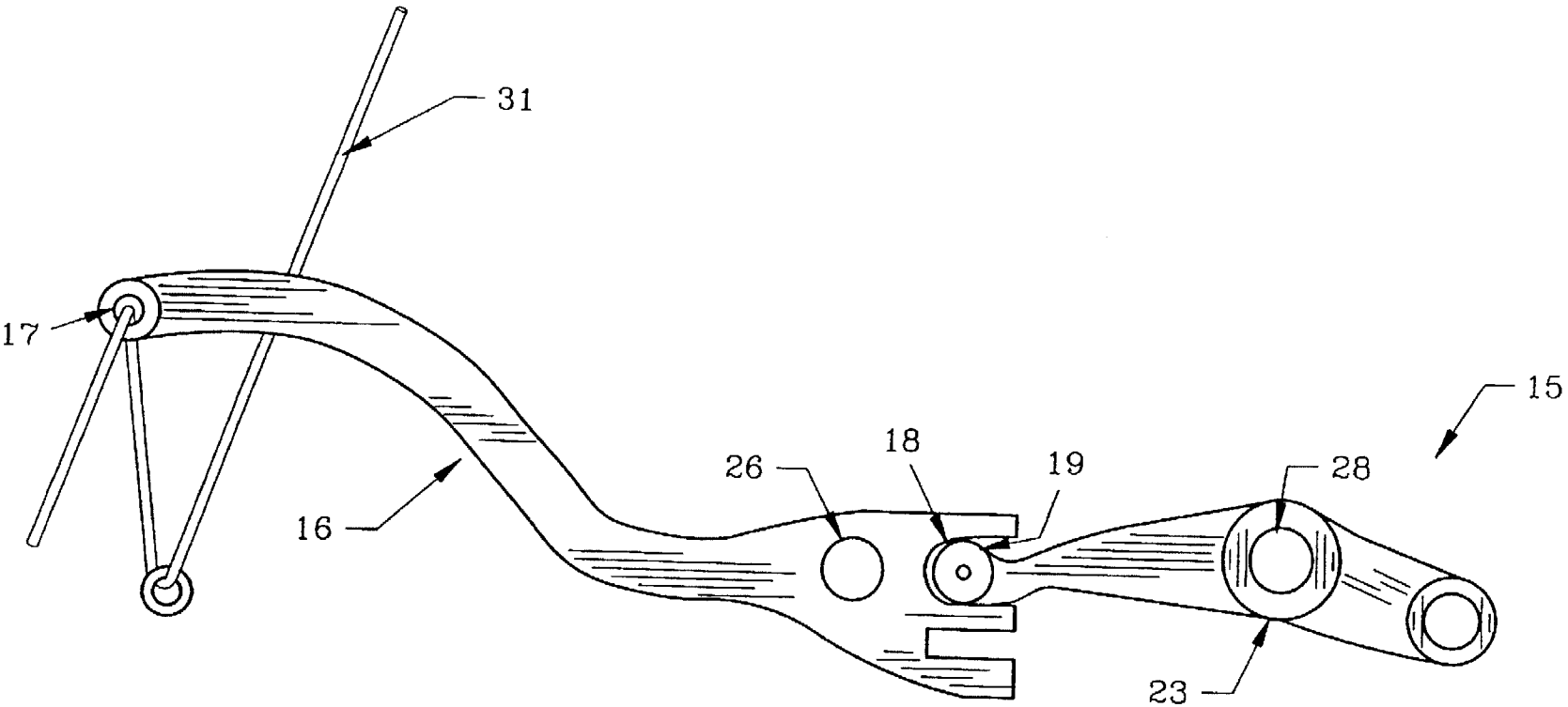
FIG. 4 depicts a side elevation view of the take-up and driver lever.

FIG. 4 shows an elevation view of movable thread take-up 16 and driver lever 15. Take-up 16 defines thread opening 17 at one end to allow thread 31 to pass therethrough from supply spool 30 and thread guide 39 to sewing hook 32. At the opposite end of take-up 16, crescent-shaped receptacle 18 allows for pivotal engagement with cylindrical extension 19 of driver lever 15. Take-up 16 pivots about pin 26 in response to the movement of driver lever 15.

Pivotable driver lever 15 is mounted upon shaft sleeve 21 and secured by attachment collar 23. Cylindrical extension 19 of driver lever 15 engages pivotally crescent-shaped receptacle 18 of take-up 16. Any rotation of servomotor output shaft 13 pivots both driver lever 15 and take-up 16. Thus, take-up 16 and driver lever 15 thereby provide means to strip thread 31 from supply spool 30 and feed it to sewing needle 32.

Figure 5:
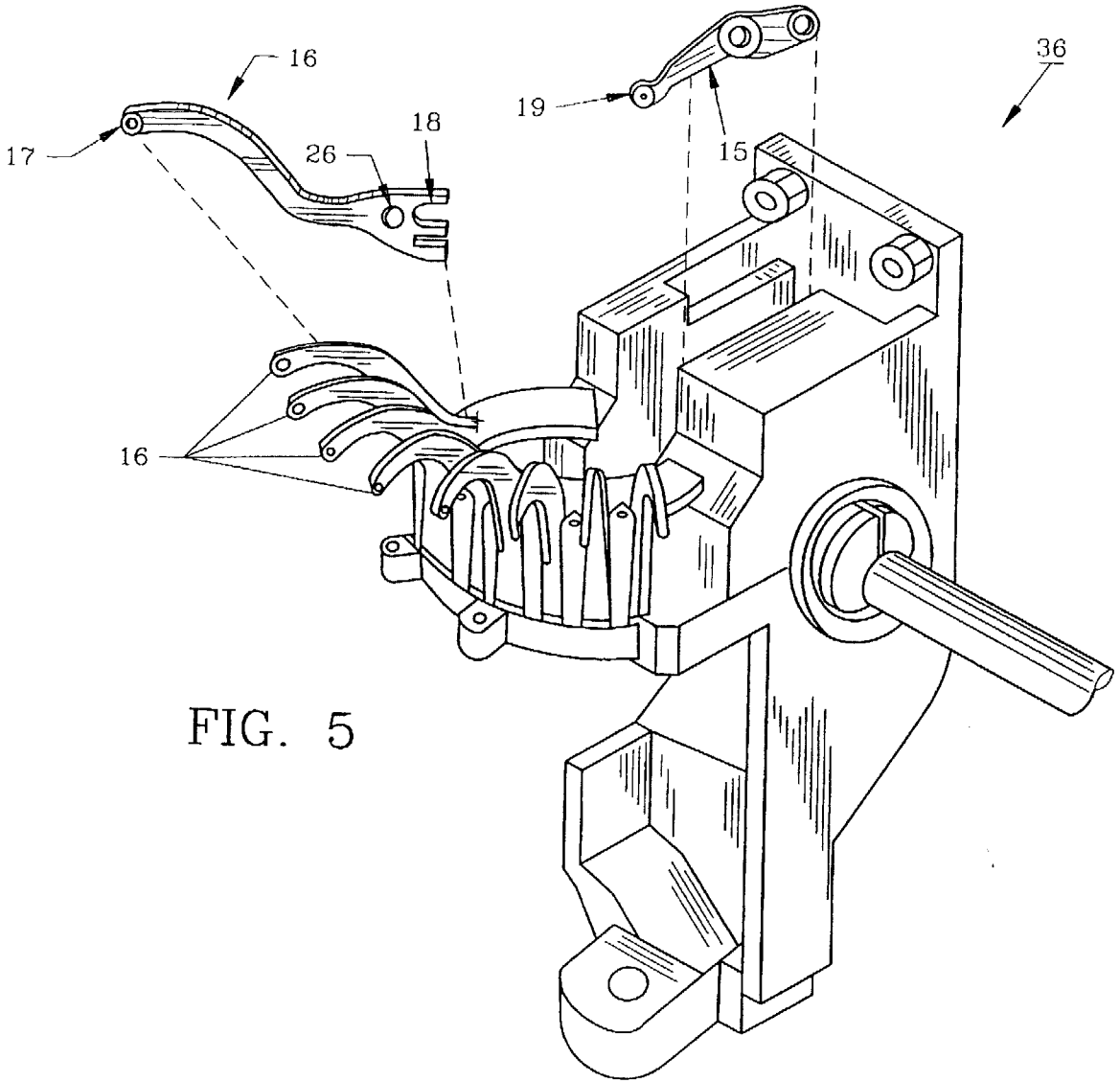
FIG. 5 features a partial view of a sewing head assembly with a take-up and driver lever exploded therefrom.

A partial view of sewing head housing 36 is illustrated in FIG. 5, with driver lever 15 and a representative take-up 16 exploded therefrom. This diagram indicates the spatial relationship among sewing head housing 36, take-ups 16, and driver lever 15. In each sewing head housing 36, there is one driver lever 15 and a plurality of take-ups 16, one for each different thread color supported by sewing head housing 36.

Figure 6A:
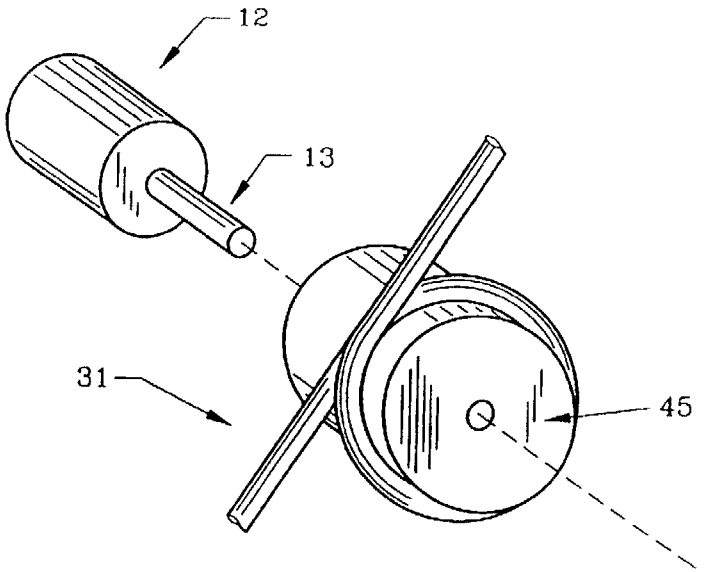
FIGS. 6*a* and 6*b* show an alternative embodiment of the invention, wherein the take-up and driver lever are replaced by a wheel.
Figure 6B:
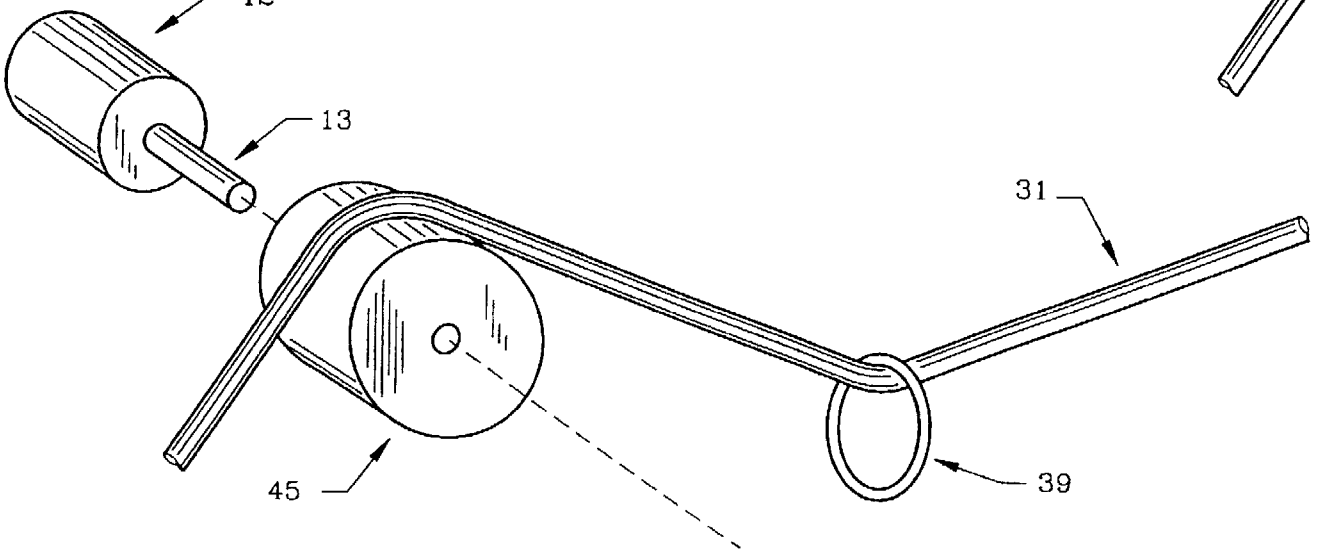

FIGS. 6*a* and 6*b* show an alternative embodiment of the invention, wherein driver lever 15 and take-up 16 are replaced by wheel 45 connected to output shaft 13 of servomotor 12. In FIG. 6*a*, thread 31 passes from supply spool 30, around the circumference of wheel 45, and then on to sewing needle 32. In FIG. 6*b*, thread 31 passes through thread guide 39, around the circumference of wheel 45, and then on to sewing needle 32. Rotating wheel 45 in one direction strips thread 31 from the supply spool. Rotating wheel 45 in the opposite direction withdraws thread 31 from sewing needle 32, thereby tightening the current stitch. In either case, the rotation of wheel 45 is controlled by the rotation of servomotor output shaft 13, which in turn is controlled by driver board 11. Driver board 11 receives signals generated by driver box 34.

As in the preferred embodiment, driver box 34 provides means to generate electrical input signals, while servomotor 12 and driver board 11 provide means to control the tension applied to thread 31. However, in this alternative embodiment, wheel 45, rather than take-up 16 and driver lever 15, provides the means to strip thread 31 from supply spool 30 and to feed it to sewing needle 32.

The illustrations and examples provided herein are for explanatory purposes and are not intended to limit the scope of the appended claims.

I claim:

1. A thread controller for a sewing machine needle, comprising:

(a) a movable thread take up;

(b) an elongated driver lever, said driver lever pivotally joined to said take up, said driver lever defining an aperture; and (c) an electric motor, said electric motor comprising an output shaft, a linear shaft sleeve, said shaft sleeve connected to said output shaft, said shaft sleeve positioned in said driver lever aperture, and said shaft sleeve and said driver lever aperture in axial alignment with said output shaft.

2. The thread controller as claimed in claim 1, wherein said movable take up defines an opening at one end to allow thread to pass therethrough.

3. The thread controller as claimed in claim 1, wherein said movable take up comprises a receptacle at one end to pivotally engage said driver lever.

4. The thread controller as claimed in claim 1, wherein said driver lever comprises an extension at one end to engage said take up.

5. The thread controller as claimed in claim 1, wherein said electric motor is a servomotor.

6. The thread controller as claimed in claim 1 and further comprising a driver board, said driver board connected to said electric motor to regulate the movement thereof.

7. The thread controller as claimed in claim 6, wherein said driver board comprises digital circuitry.

8. A system for controlling the length of thread fed to a reciprocating needle during stitch formation on a sewing machine, the sewing machine having a movable frame for supporting a work piece, while the position of the reciprocating needle is output by a coder, said system comprising:

(a) an electric motor, said electric motor comprising an output shaft;

(b) a driver board connected to said electric motor, said driver board for controlling said electric motor, said driver board in electrical communication with the coder and the frame, said driver board responsive to electrical signals transmitted by the frame and the coder;

(c) an elongated driver lever, said driver lever defining an aperture, said driver lever aperture for receiving the output shaft of said electric motor;

(d) a take up lever joined to said elongated driver lever, said take up lever defining an aperture for reception of the thread and passage of the thread to the needle;

whereby the length of thread fed to the needle is controlled by the movement of the frame and by the position of the reciprocating needle.

9. The system of claim 8, wherein said electric motor comprises a servomotor.

10. The system of claim 8, wherein said electric motor comprises a stepping motor.

11. The system of claim 8, wherein said driver board comprises a programmable logic controller.

12. The system of claim 8, further comprising an inductive coil, said inductive coil in communication with said driver board.

13. The system of claim 8, further comprising an optical switch, said optical switch in communication with said driver board.

14. The system of claim 13, wherein said optical switch generates electrical signals representing movement of the frame.

15. A method of controlling the length of thread fed to a needle during stitch formation on a sewing machine, the sewing machine having a movable frame for supporting a work piece and a coder for outputting the position of the needle, said method comprising the steps of:

(a) providing an electrical control signal transmitted by the coder representing the position of the needle;

(b) providing an electrical control signal transmitted by the frame representing movement of the frame;

(c) inputting the electrical control signals representing the needle position and the frame movement to a driver board;

(d) controlling the operation of an electric motor with the driver board in response to the needle position and the frame movement; and (e) pivoting a take up lever connected to the electric motor to feed thread passing through the take up lever to the needle.

16. The method of claim 15, wherein controlling the operation of an electric motor comprises controlling the operation of a servomotor.

17. The method of claim 15, wherein controlling the operation of an electric motor comprises controlling the operation of a stepper motor.

18. The method of claim 15, wherein providing an electrical control signal transmitted by the frame comprises providing an electrical control signal transmitted by an optical switch.

* * * * *